US006470928B1

(12) United States Patent
Davis et al.

(10) Patent No.: US 6,470,928 B1
(45) Date of Patent: Oct. 29, 2002

(54) PRODUCT SAVER

(76) Inventors: Tom Davis, 1537 Idylwild, Prescott, AZ (US) 86305; Tim Walker, 1537 Idlylwild, Prescott, AZ (US) 86305

( * ) Notice: Subject to any disclaimer, the term of this patent is extended or adjusted under 35 U.S.C. 154(b) by 0 days.

(21) Appl. No.: 10/025,433

(22) Filed: Dec. 19, 2001

Related U.S. Application Data

(60) Provisional application No. 60/255,743, filed on Dec. 14, 2000.

(51) Int. Cl.[7] ..... B65B 1/04
(52) U.S. Cl. ..... 141/364; 141/301
(58) Field of Search ..... 141/364, 106, 141/367, 378, 383–386, 301; 137/614, 614.01, 614.06; 251/149.9

(56) References Cited

U.S. PATENT DOCUMENTS

| | | | | | |
|---|---|---|---|---|---|
| 3,939,884 | A | * | 2/1976 | Mader | 141/333 |
| 4,170,252 | A | * | 10/1979 | Peterson | 141/331 |
| 5,540,266 | A | * | 7/1996 | Grau et al. | 137/614 |
| 6,065,649 | A | * | 5/2000 | Scoggins | 141/106 |

* cited by examiner

*Primary Examiner*—Steven O. Douglas
(74) *Attorney, Agent, or Firm*—Joseph N. Breaux

(57) ABSTRACT

A product saver for facilitating the transfer of the contents of an upper most bottle to a cavity within a lower most bottle. The device includes a pair of fittings between which a butterfly valve is positioned such that the contents of the upper most bottle can settle against the butterfly valve which can then be opened and allowing the rapid transfer of the contents of the upper most bottle into the cavity of the lower most bottle.

2 Claims, 3 Drawing Sheets

FIG3a
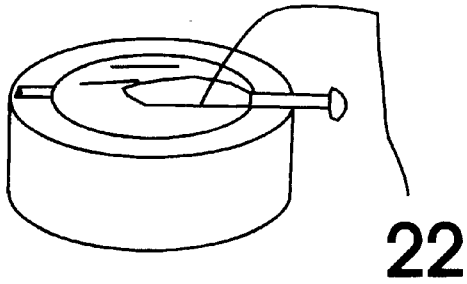
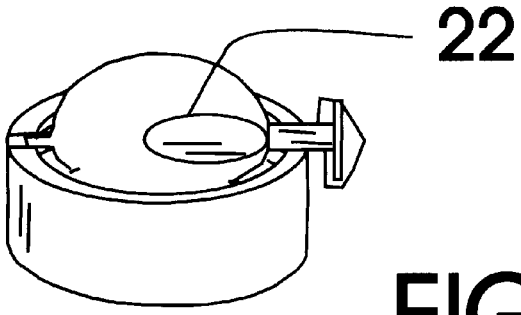
FIG.3
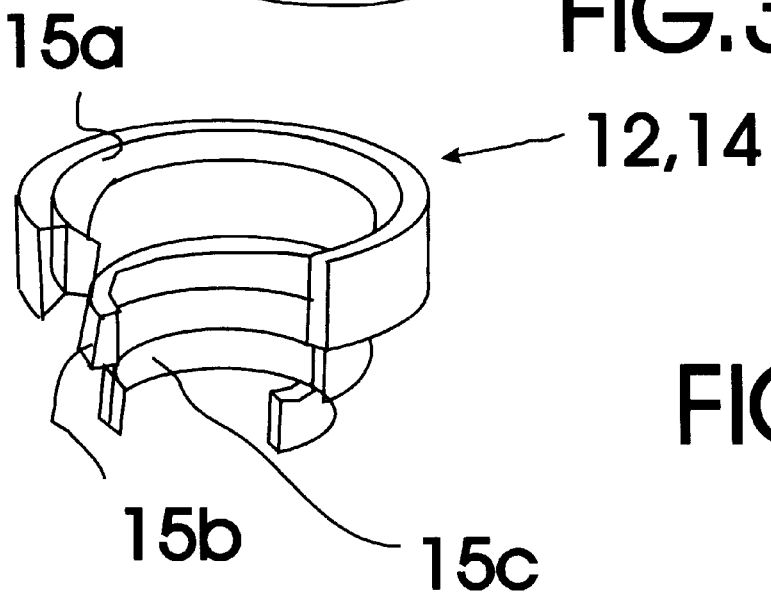
FIG.2

PRODUCT SAVER

This application claims the benefit of provisional application 60/255,743 filed Dec. 14, 2000.

TECHNICAL FIELD

The present invention relates to condiment transfer devices and more particularly to a transfer device for connecting two bottles having various sizes to each other in a vertical orientation such that the contents of an upper most bottle can be transferred to a cavity within a lower most bottle; the device including a pair of connecting fittings adapted to connect to the threaded openings of the upper and lower bottles that have a baffle to member positioned there between in the form of a butterfly valve which can be shut so that contents of the upper bottle can settle downward until the user decides to open the butterfly valve allowing the contents of the upper bottle or container to slide through into the cavity of the other bottle; each pair of connecting fittings includes multiple internally threaded portions arranged such that internally threaded portions are arranged such that the largest diameter internally threaded portions are farthest from the baffle member and are arranged in order of decreasing diameter.

BACKGROUND OF INVENTION

It is often desirable to consolidate the contents of multiple bottles of condiments and the like such as ketchup into a single bottle so that it is easier to store. It would be desirable, therefore, to have a device which could be connected between a pair of bottles such that the contents of an upper bottle could be allowed to be directed into the cavity of a lower bottle. In order to facilitate the transfer from the upper bottle to the lower bottle. In order to facilitate the transfer from the upper bottle to the lower bottle, it would be a benefit if the device included a baffle such as a butterfly valve which would allow the contents of the upper bottle to settle up against the butterfly valve and which would rapidly allow the contents of the upper bottle to slide into the cavity of the lower bottle once the butterfly valve or baffle is opened. Because it may be desirable to have such a device wherein the bottle connecting fittings were each provided with multiple internally threaded portions that are adapted for connection with bottles having different diameter openings and different thread configurations.

SUMMARY OF INVENTION

It is thus an object of the invention to provide a product saver that includes a transfer device for connecting two bottles having various sizes to each other in a vertical orientation such that the contents of an upper most bottle can be transferred to a cavity within a lower most bottle; the device including a pair of connecting fittings adapted to connect to the threaded openings of the upper and lower bottles that have a baffle member positioned there between in the form of a butterfly valve which can be shut so that contents of the upper bottle can settle downward until the user decides to open the butterfly valve allowing the contents of the upper bottle or container to slide through into the cavity of the other bottle; each pair of connecting fittings includes multiple internally threaded portions arranged such that internally threaded portions are arranged such that the largest diameter internally threaded portions are farthest from the baffle member and are arranged in order of decreasing diameter.

Accordingly, a product saver is provided. The product saver includes a transfer device for connecting two bottles having various sizes to each other in a vertical orientation such that the contents of an upper most bottle can be transferred to a cavity within a lower most bottle; the device including a pair of connecting fittings adapted to connect to the threaded openings of the upper and lower bottles that have a baffle member positioned there between in the form of a butterfly valve which can be shut so that contents of the upper bottle can settle downward until the user decides to open the butterfly valve allowing the contents of the upper bottle or container to slide through into the cavity of the other bottle; each pair of connecting fittings includes multiple internally threaded portions arranged such that internally threaded portions are arranged such that the largest diameter internally threaded portions are farthest from the baffle member and are arranged in order of decreasing diameter.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 2 is a cutaway view of one of the pair of connecting fittings showing the multiple internally threaded portions arranged such that internally threaded portions are arranged such that the largest diameter internally threaded portions are farthest from the baffle member and are arranged in order of decreasing diameter.

FIG. 3 shows the butterfly valve or baffle in the closed position.

FIG. 3*a* shows the butterfly valve or baffle in the opened position.

EXEMPLARY EMBODIMENTS

Figure 1:
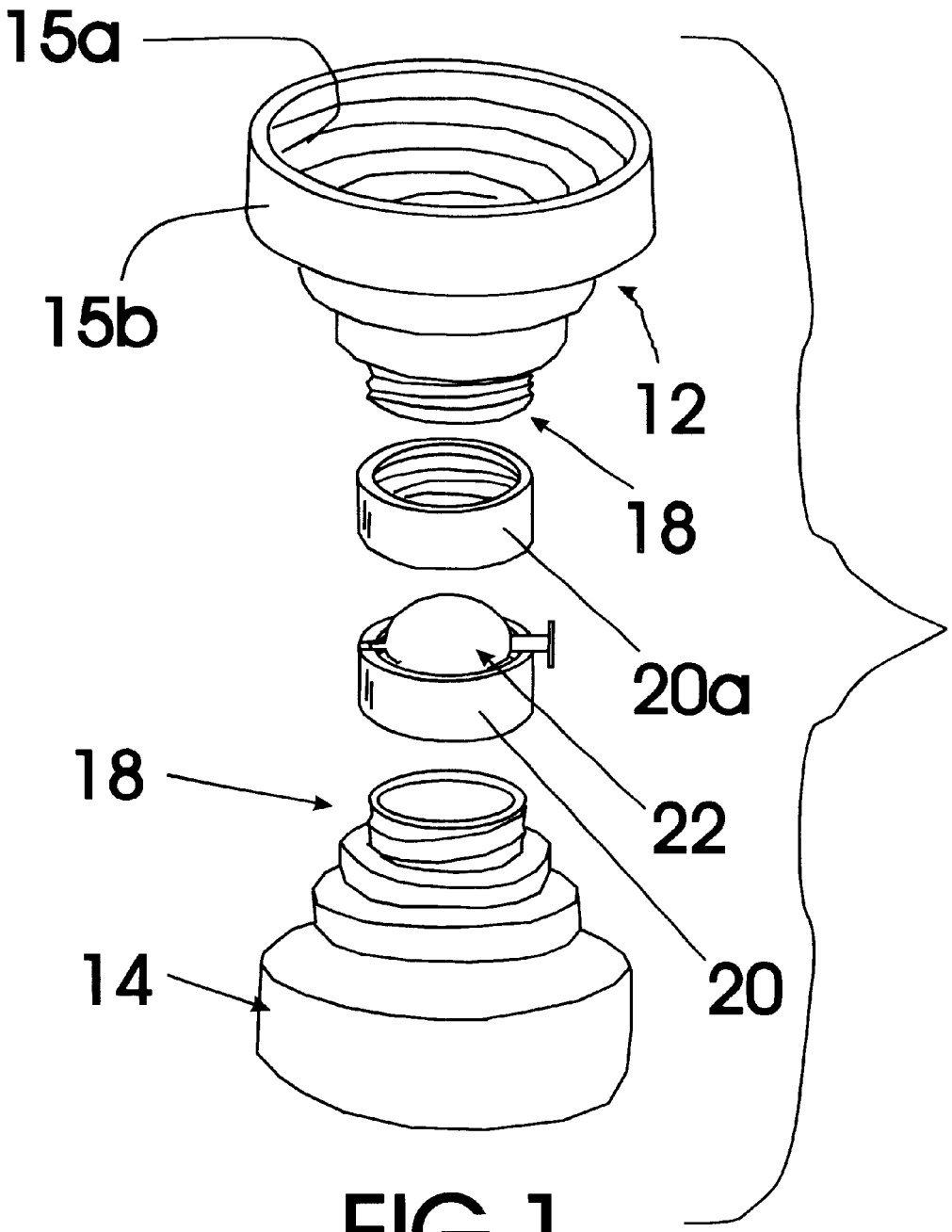
FIG. 1 is an exploded view of a first exemplary embodiment of the device of the present invention wherein each pair of connecting fittings includes multiple internally threaded portions arranged such that internally threaded portions are arranged such that the largest diameter internally threaded portions are farthest from the baffle member and are arranged in order of decreasing diameter.

FIGS. 1 through 6 show various aspects of an exemplary embodiment of the product saver of the present invention generally designated 10 and 10*a*.

Product saver 10 includes a pair of connecting fittings generally designated 12, 14 which each include multiple internally threaded portions 15*a-c* that each of a different diameter and threadable using externally threaded ends 18 to a respective portion of a baffle assembly 20, 20*a*. A butterfly valve or baffle assembly generally designated 22 is positioned between baffle 20 assembly 20, 20*a* so that the user can connect an upper most bottle to attachment 12 and a lower most bottle to attachment 14 to let the contents of the upper bottle settle downward and then open butterfly valve 22 to allow the contents of the upper bottle to rapidly fill the cavity of the lower bottle.

Figure 4:
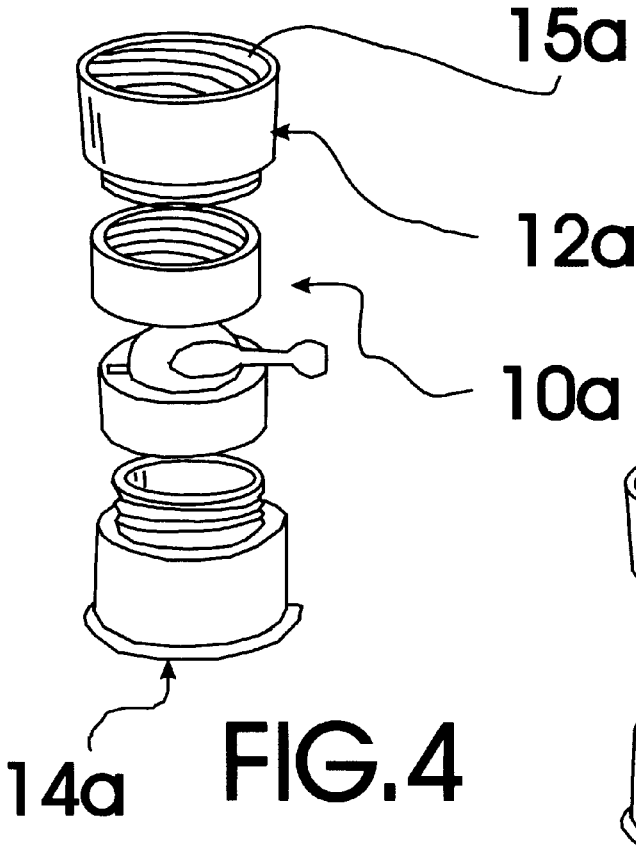
FIG. 4 is a an exploded view of a second exemplary embodiment of the device of the present invention.
Figure 5:
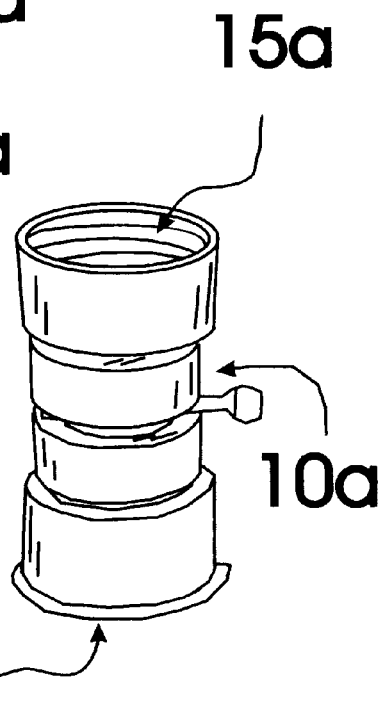
FIG. 5 is a partially assembled view of the device of FIG. 4.
Figure 6:
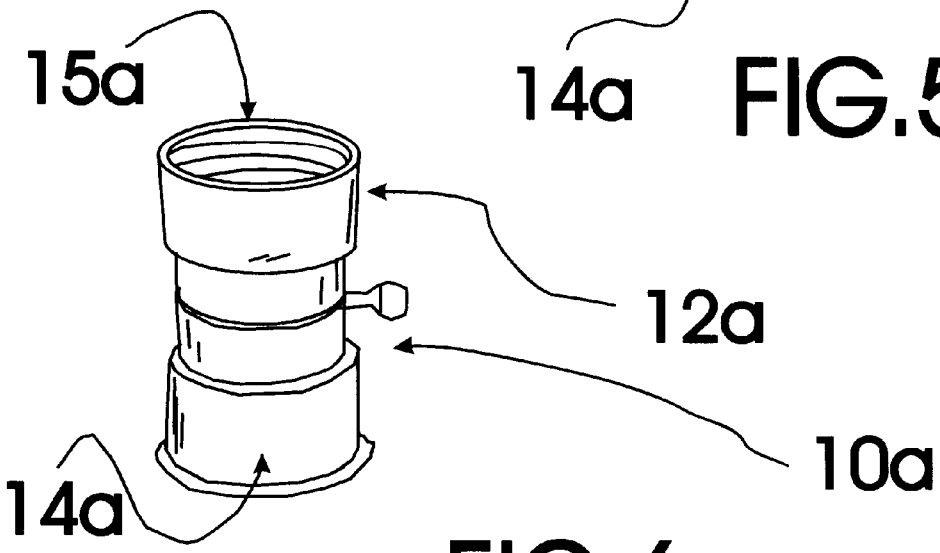
FIG. 6 is a fully assembled view of the device of FIG. 4.

FIGS. 4–6 show a second exemplary embodiment of the product saver, generally designated 10*a*, that is identical to product saver 10 except that the pair of connecting fittings

12*a*, 14*a* of product saver 10 include only a single internally threaded portion 15*a* for connection with a bottle opening.

It can be seen from the preceding description that a product saver has been provided.

It is noted that the embodiment of the product saver described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A product saver for transferring the contents of one container having a threaded top opening to another container having a threaded container opening comprising:

a pair of connecting fittings adapted to connect to the threaded openings of the upper and lower bottles that have a baffle member positioned there between in the form of a butterfly valve which can be shut so that contents of the upper bottle can settle downward until the user decides to open the butterfly valve allowing the contents of the upper bottle or container to slide through into the cavity of the other bottle;

each pair of connecting fittings includes multiple internally threaded portions arranged such that internally threaded portions are arranged such that the largest diameter internally threaded portions are farthest from the baffle member and are arranged in order of decreasing diameter.

2. A product saver for transferring the contents of one container having a threaded top opening to another container having a threaded container opening comprising:

a pair of connecting fittings each adapted to connect to the threaded container opening;

a baffle member positioned between the pair of connecting fittings including a butterfly valve which can be shut so that contents of a first container threadably connected to a first one of the pair of connecting fittings can move through the baffle member into a second container threadably connected to a second one of the pair of connecting fittings;

movement of container contents occurring from a higher oriented connecting fitting of the pair of connecting fittings to a lower oriented connecting fitting of the pair of connecting fittings;

the butterfly valve being closeable to allow the contents of an inverted top container connected to higher oriented connecting fitting to settle from the bottom section of the inverted top container to the top of the inverted top container and in contact with the baffle member such that when the butterfly valve is opened, the contents of the inverted top container may quickly slide through the baffle member and into a right side up container threadably connected to the other one of the connecting fittings.

* * * * *